United States Patent [19]

Herd, Jr. et al.

[11] Patent Number: 4,663,090

[45] Date of Patent: May 5, 1987

[54] FUEL CONTROL SYSTEM FOR A CARBURETOR

[75] Inventors: William H. Herd, Jr., Fresno; John W. Hansen, Rocklin, both of Calif.

[73] Assignee: Pollution Controls Industries, Inc., Tulare, Calif.

[21] Appl. No.: 774,990

[22] Filed: Sep. 11, 1985

[51] Int. Cl.[4] ..... F02M 9/08

[52] U.S. Cl. ..... 261/41.3; 261/44.7

[58] Field of Search ..... 261/44 F, 41 B, 34 R

[56] References Cited

U.S. PATENT DOCUMENTS

| | | | |
|---|---|---|---|
| 1,444,222 | 2/1923 | Trego | 261/41 B |
| 1,753,235 | 4/1930 | Duff | 261/41 B |
| 2,777,678 | 1/1957 | Udale | 261/44 F |
| 3,409,277 | 11/1968 | Reise | 261/71 |
| 3,711,068 | 1/1973 | Perry | 261/41 B |
| 4,056,583 | 11/1977 | Shinoda et al. | 261/44 F |
| 4,100,663 | 7/1978 | Crum | 261/34 R |
| 4,180,534 | 12/1979 | Cutler | 261/41 B |
| 4,212,833 | 7/1980 | Harrington | 261/39 A |
| 4,283,355 | 8/1981 | Herd, Jr. et al. . | |

FOREIGN PATENT DOCUMENTS

| | | | |
|---|---|---|---|
| 122841 | 4/1948 | Austria | 261/44 F |
| 2546560 | 4/1977 | Fed. Rep. of Germany | 261/44 F |

*Primary Examiner*—Tim Miles

*Attorney, Agent, or Firm*—Worrel & Worrel

[57] ABSTRACT

A fuel control system for a carburetor. The fuel control system includes a primary restrictor, primary adjustable jet and secondary restrictor connecting a carburetor reservoir and nozzle bar in fluid-flow relation to a fuel supply. Adjustment and metering means control the amount of fuel that is provided to the carburetor nozzle bar.

2 Claims, 10 Drawing Figures

FUEL CONTROL SYSTEM FOR A CARBURETOR

BACKGROUND OF THE INVENTION

1. Field of the Invention

The present invention relates to a fuel control system for a carburetor, used in combination with an internal combustion engine particularly adapted accurately to meter the fuel requirements for small, four-cylinder engines having displacements of 100 to 150 cubic inches.

2. Description of the Prior Art

Carburetors having variable venturi plates utilized to meter fuel for all operational modes of an internal combustion engine are well known. A carburetor of this type is disclosed in U.S. Pat. No. 4,283,355 to Pollution Controls Industries, Inc. of Tulare, Calif., issued on Aug. 11, 1981.

The carburetor disclosed in the aforementioned patent is characterized by pivotally positionable venturi plates whose movement is precisely coordinated with that of a fuel metering element adapted to provide a desired air-fuel mixture ratio at all positions of the plate, and particularly at positions of the plates corresponding to relatively low flow of air through the carburetor, as during idling and other low-speed operations. While the carburetor disclosed in this U.S. Pat. No. 4,283,355, functions quite well for metering large amounts of fuel for engines of displacement of 300 cubic inches or more, it does not function as well for engines of 100 through 150 cubic inches, which consume proportionately smaller amounts of fuel.

Research conducted on the problems associated with metering these small amounts of fuel has shown that the mechanical system disclosed in the aforementioned patent does not work as well in the smaller engines because the precision required to produce the elements that comprise the invention cannot be achieved in a cost-effective manner. The present invention overcomes these problems of the prior art by providing a fuel control system that has a primary and secondary system. The primary system, herein disclosed, provides fuel to the carburetor for idling and part throttle operation, and the secondary system meters fuel for wide-open throttle operation only.

According to the present teaching, a fuel control system for a carburetor is provided having a primary restrictor and a primary adjustable jet which provide fuel to a nozzle bar that is located in the throat of the carburetor equipped with symmetrically disposed, pivotally positionable venturi plates. The fuel supplied by the primary restrictor and the primary adjustable jet constitute the primary fuel supply system for idling and partthrottle operation of the engine. A secondary restrictor is provided which has a mechanical metering system adapted to control the fuel provided from the secondary restrictor to the fuel being provided from the primary adjustable jet and the primary restrictor. The metering system that controls the fuel moving from the secondary restrictor is connected to, and its movement corresponds with, the movement of the symmetrically disposed venturi plates which are pivotally positioned in the throat of the carburetor. The movement of the pivotally positionable venturi plates is largely a function of the mass of air flow moving through the throat of the carburetor.

This approach allows for the effective metering of the small amounts of fuel required by engines of small displacement. This approach furthermore overcomes the problems of the prior art in that the precision required to produce the elements of the prior art patent is not required of a carburetor of this particular design.

OBJECTS AND SUMMARY OF THE INVENTION

Accordingly, it is an object of the present invention to provide a fuel control system for a carburetor which is used in engines of small displacement.

Another object is to provide a fuel control system for a carburetor that utilizes a combination of fixed metering and mechanical metering to control the fuel provided to the carburetor.

Another object is to provide a fuel control system wherein movement of the pivotally positionable venturi plates causes the activation of a fuel metering element that controls the fuel provided for wide-open throttle operation.

Further objects and advantages are to provide the improved elements and arrangements thereof in a fuel control system for a carburetor having a primary restrictor, a primary adjustable jet and a secondary restrictor that meters fuel to the nozzle bar in relation to the position of the venturi plates in the throat of the carburetor providing a desired fuel mixture ratio at open-throttle operations and being dependable and fully effective in performing its intended purpose.

DESCRIPTION OF THE FIRST OPERATIONAL EMBODIMENT

Figure 1:
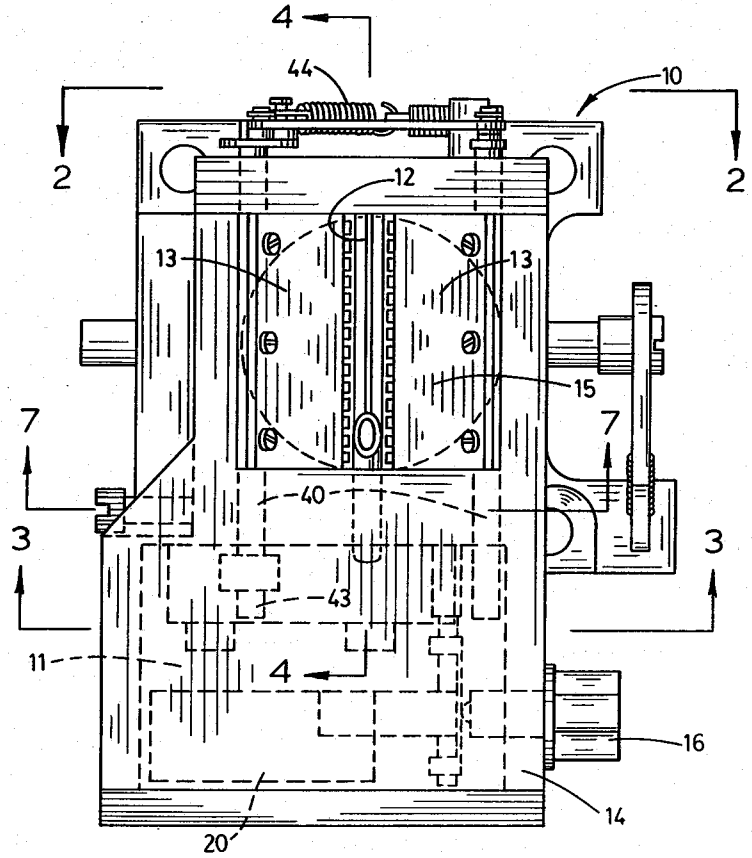
FIG. 1 is a plan view of the carburetor incorporating a fuel control system of the present invention in a first operational embodiment.
Figure 4:
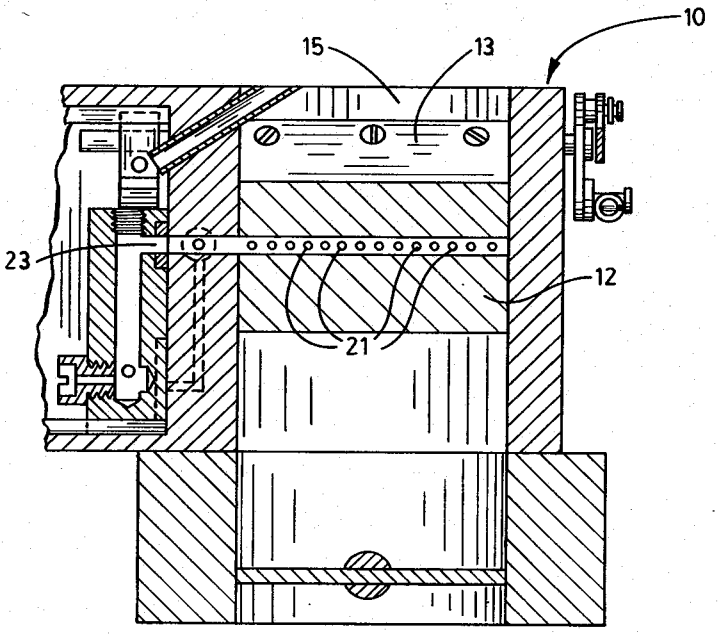
FIG. 4 is a partial side elevation section taken on line 4—4 of FIG. 1.

Referring more particularly to the drawings, a carburetor incorporating a fuel control system of the present invention is generally indicated by numeral 10 in FIG. 1. The fuel control system of the present invention is adapted for use in a carburetor, but more particularly, the fuel control system is adapted for use in carburetors which provide the fuel to four-cylinder engines having displacements from approximately 100 to 150 cubic inches. As depicted in FIG. 1, a carburetor 10 has a reservoir 11, a nozzle bar 12, and pivotally positionable venturi plates located in a symmetrically disposed position in the throat of the carburetor, designated by the numeral 13. The carburetor is of a conventional type insofar as the carburetor has a housing 14 that defines a throat 15 through which air and fuel are drawn during the operation of such an engine used therewith. The reservoir is attached to a fuel line which enters in through the side of the carburetor housing at a fuel intake port 16. A float, designated by numeral 20 in FIG. 1, is pivotally mounted within the fuel reservoir and operates in a conventional manner whereby the float controls the amount of fuel which enters into the reservoir chamber.

Figure 3:
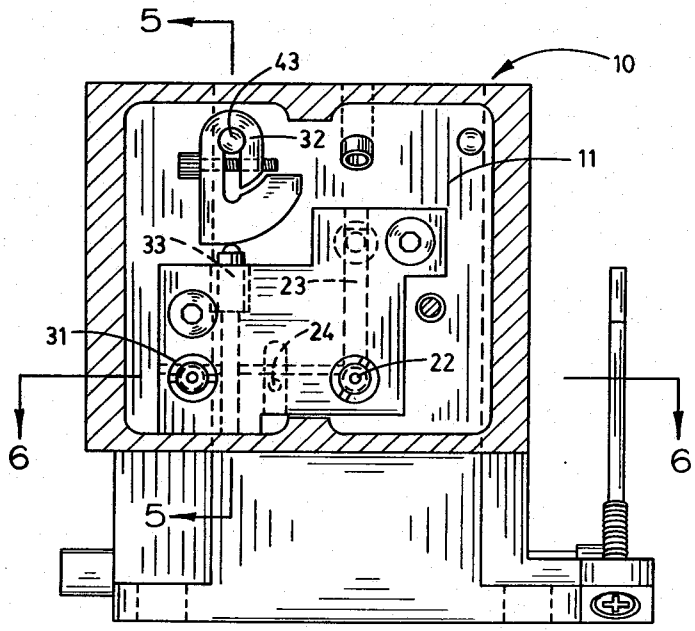
FIG. 3 is a sectional side elevation of the fuel reservoir of a carburetor having a fuel control system in a first operational embodiment of the present invention taken on line 3—3 in FIG. 1.
Figure 6:
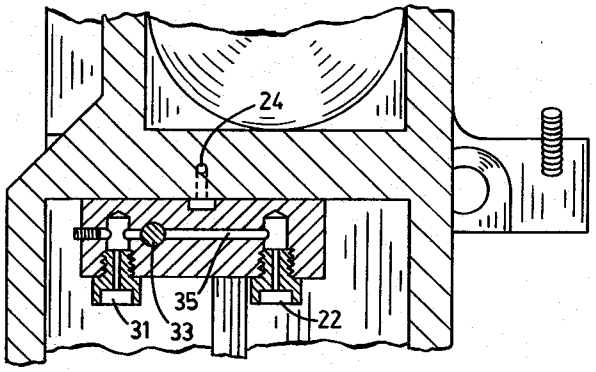
FIG. 6 is an isometric, sectional view taken on line 6—6 of FIG. 3.
Figure 7:
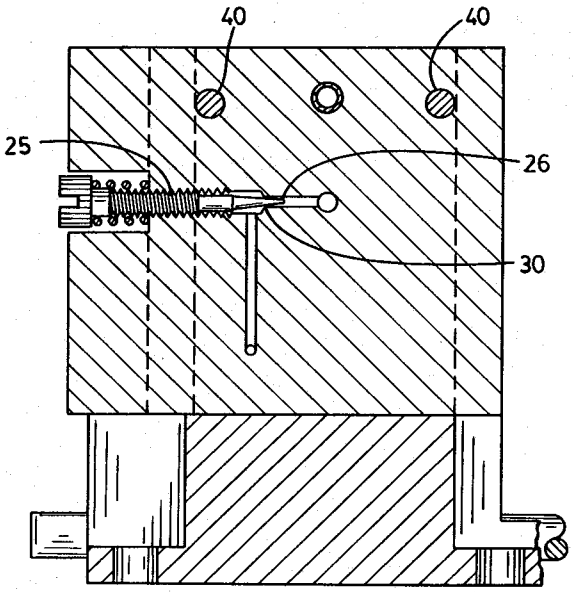
FIG. 7 is an isometric, sectional view taken on line 7—7 of FIG. 1.
Figure 5:
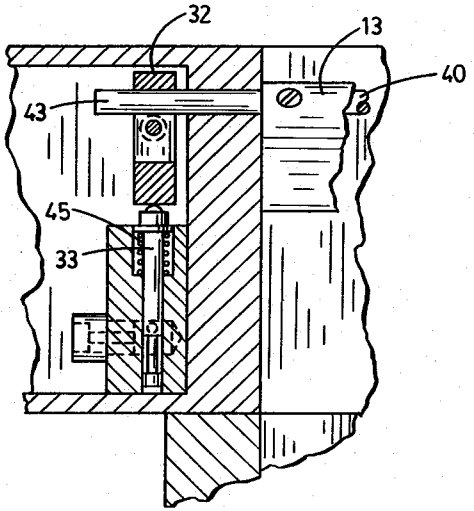
FIG. 5 is an isometric, sectional view through line 5—5 in FIG. 3.

FIG. 3 is a side elevation sectional view of the fuel reservoir taken through line 3—3 of FIG. 1. Depicted therein is the fuel control system of the present invention. As shown, the primary restrictor 22 connects a carburetor reservoir 11 and the carburetor nozzle bar 12 in fluid-flow relation. The nozzle bar is mounted in the throat 15 between the pivotally positionable venturi plates 13. In addition, the nozzle bar has a plurality of laterally disposed orifices 21 between the plates. The primary restrictor 22 leads to a conduit 23 which connects the restrictor in fluid-flow relation to the nozzle bar. The primary adjustable jet 24 has a screw-threadable adjustment member 25, as shown in FIG. 7. This screw-threadable adjustment member functions as a valve connecting the primary adjustable jet in fluid-flow relation between the source of fuel and the nozzle bar, for adjustment of the idling rate of the carburetor 10. This adjustment member has a conical forward end 26 which engages a peripheral seat 30 defining an annular flow passage when the adjustment member is displaced from the seat.

Figure 8:
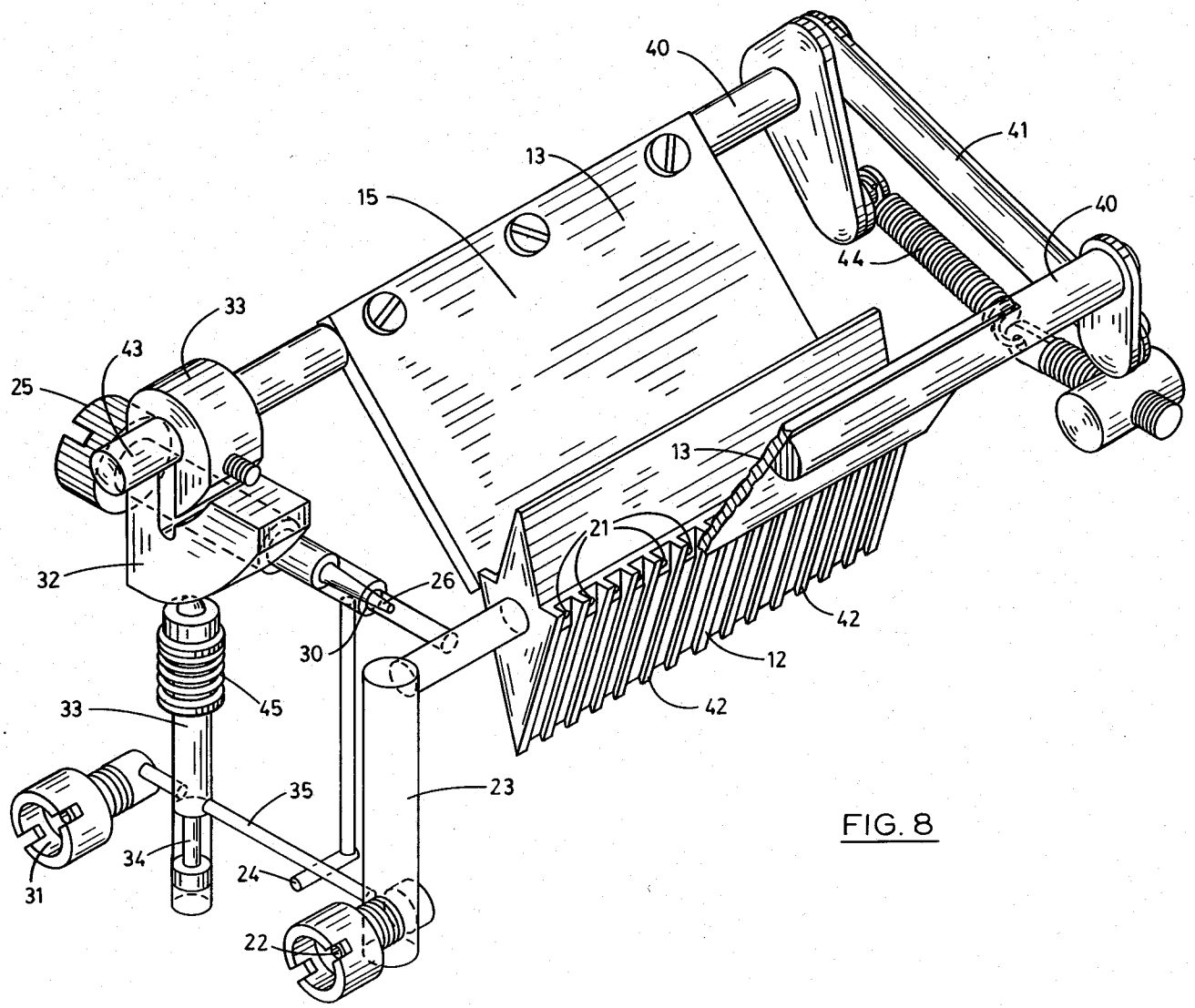
FIG. 8 is a flow schematic view of a fuel control system of the present invention in a first operational embodiment with supporting surfaces removed.

A secondary restrictor 31, in the first operational embodiment of the subject invention, functions in conjunction with a metering cam 32. This cam is mounted in impeding relation axially of a spring-loaded plunger 33 to prevent the extension thereof. This spring-loaded plunger has a decreased diameter portion 34, as shown in FIG. 8. This decreased diameter portion is adapted to allow fuel to pass from the secondary restrictor to the fuel passage designated by numeral 35. The secondary restrictor is connected via the fuel passage in fluid-flow relation between the source of fuel and the nozzle bar. The secondary restrictor has a passage of predetermined cross-sectional area. In addition, the primary and secondary restrictors are removable and replaceable, thus permitting restrictors of different cross-sectional area to be utilized which would allow the engine to perform at different performance levels. The secondary restrictor, working in combination with the metering cam, in the first operational embodiment, constitutes a secondary system for flow metering for full-throttle operation of the engine. The fuel provided from the primary adjustable jet 24 and the secondary restrictor 31 is deposited in the conduit 23 that connects the primary restrictor and the nozzle bar 12 located in the throat of the carburetor 15.

Figure 2:
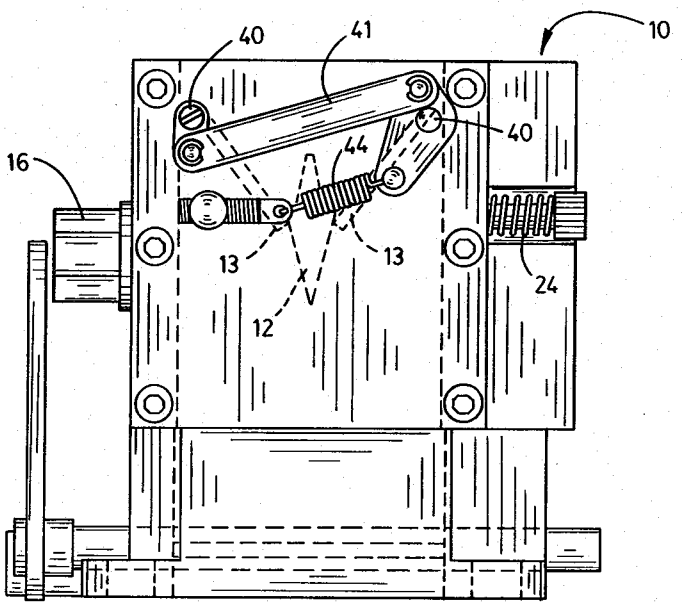
FIG. 2 is a side elevation showing the linkage of the pivotally positionable venturi plates taken on line 2—2 in FIG. 1.

The pivotally positionable venturi plates 13 are held in symmetrically disposed position in the carburetor throat 15 forming a venturi therewith, and are movable between a closed attitude wherein the throat is substantially occluded and an open attitude wherein the throat is substantially open. The pivotally positionable venturi plates are movable between a closed and open attitude by axles designated by the numeral 40. As depicted in FIG. 8, the variable venturi plates 13 are attached to the axle 40 by screws or other similar fastening devices. As shown in FIG. 2, the pivotally positionable venturi plates 13, shown in phantom lines, are permitted to move in pivotally positionable attitude within the throat 15 of the carburetor 10 by a linkage device, generally indicated by numeral 41. This linkage device, as depicted, is adapted for automatically, substantially, equally and oppositely pivotally positioning the venturi plates in response to the operation of an internal combustion engine that has a carburetor 10 mounted thereon. It is obvious that the linkage device is adapted such that the pivotally positionable venturi plates move substantially in unison away from the nozzle bar as air rushes in through the throat of the carburetor. As illustrated the pivotally positionable venturi plates are of such dimensions that they engage the nozzle bar 12 at a point adjacent to a plenary number of ribs 42 that separate the plenary number of laterally disposed orifices, indicated by number 21. One of the axles 40 which has affixed thereto a venturi plate 13, has a first end 43. As shown in FIG. 1 and in FIG. 3, the first end of this axle extends through the carburetor housing 14 and into the reservoir 11. As depicted in FIG. 3, the metering cam 32 is secured by a suitable screw to the first end of the venturi axle. In operation, it should be obvious that as air rushes in the throat of the carburetor 15, the pivotally positionable venturi plates move in a substantially uniform fashion from a closed attitude, where the throat is substantially occluded to an open attitude where the throat is substantially open, due to the effects of the linkage device 41 away from the nozzle bar 12. This movement of the venturi plates away from the nozzle bar causes the first end of the venturi axle to turn in corresponding fashion, thus rotating the metering cam 32 which is attached to the first end. Likewise, when the air rushing in the throat of the carburetor decreases, the linkage device for the pivotally positionable venturi plates permits movement of the pivotally positionable plates back to a position wherein the throat of the carburetor is substantially occluded. This movement back to this occluded position is accomplished by a spring 44 which is attached to the linkage device.

DESCRIPTION OF THE SECOND OPERATIONAL EMBODIMENT

Figures 9, 10:
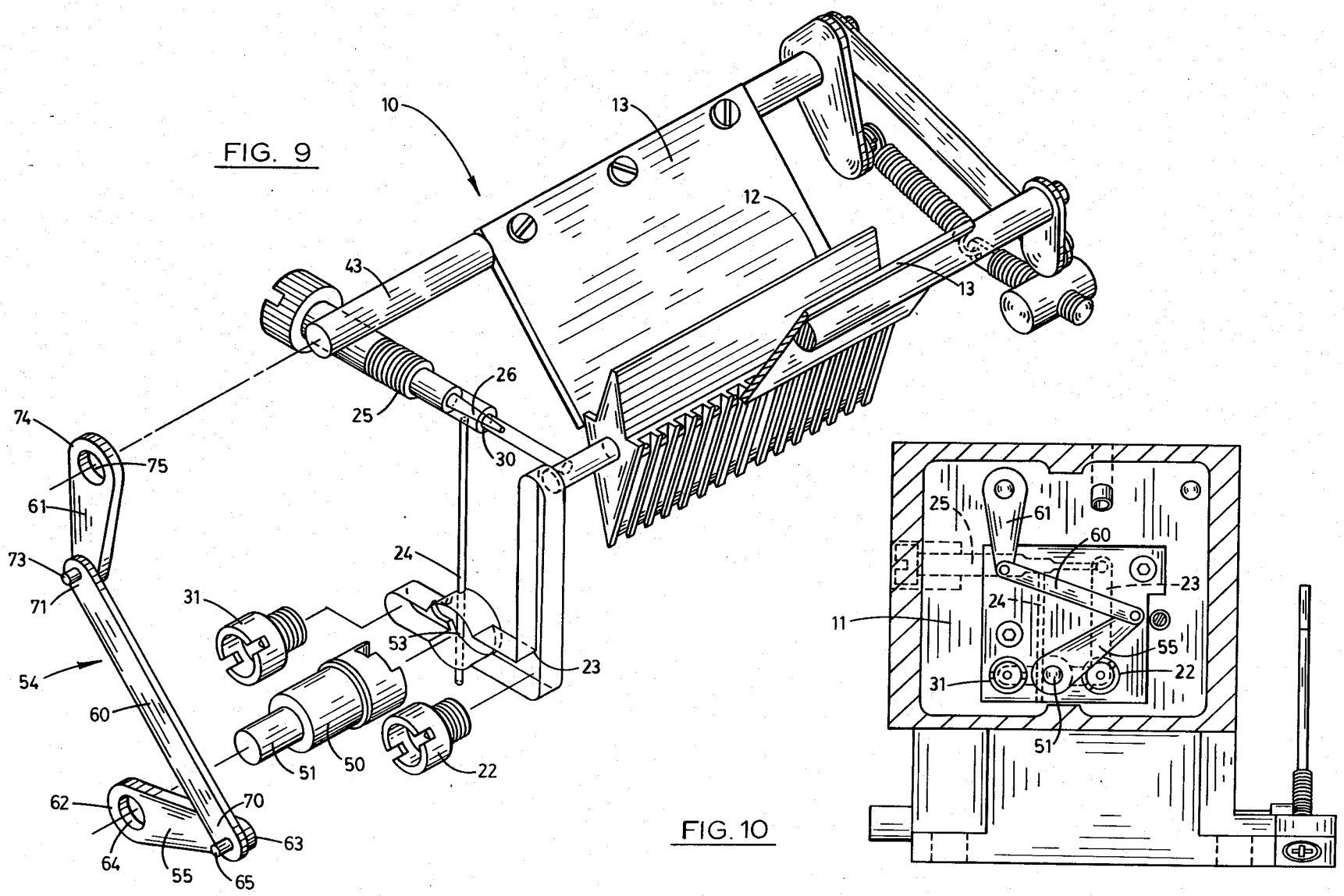
FIG. 9 is a flow schematic view of a fuel control system of the present invention in a second operational embodiment with supporting surfaces removed.
FIG. 10 is a sectional side elevation of the fuel reservoir of a carburetor having a fuel control system, in a second operational embodiment, of the present invention.

Referring more particularly to the drawings, a carburetor incorporating a second operational embodiment of the present invention is generally indicated by the numeral 10 in FIG. 9. As described earlier in the description of the first operational embodiment, the fuel control system is adapted for use in carburetors which provide the fuel to four-cylinder engines having displacements from approximately 100 to 150 cubic inches.

As depicted in FIG. 9, this flow schematic view clearly illustrates the fuel control system of the second operational embodiment. It will be noted that many of the elements of the second form of the invention are the same as the corresponding elements of the first form. Where this occurs, the same element identifying numerals are employed to identify the same elements in both forms. The carburetor 10 has a reservoir 11, a nozzle bar 12, and pivotally positionable venturi plates 13 located in a symmetrically disposed position in the throat 15 of the carburetor. Located in the reservoir is a rotary valve 50. The rotary valve is of conventional design having an actuating shaft 51 which is adapted for rotational movement about its longitudinal axis. Motion of the actuating shaft causes the rotary valve to be placed in an appropriate attitude which permits fluid to flow therethrough.

Adjacent thereto the rotary valve 50 is the primary restrictor 22 which has heretofore been described in significant detail in the description of the first operational embodiment of the present invention. The primary restrictor in the second operational embodiment connects a carburetor reservoir 11 and the carburetor nozzle bar 12 in fluid-flow relation. The primary restrictor 22 leads to conduit 23 which connects the primary restrictor in fluid-flow relationship with the nozzle bar 12. The primary restrictor permits fuel to flow therethrough into the conduit 23 and thence into the nozzle bar.

A primary adjustable jet 24 is similarly provided in the second operational embodiment of the present invention. It functions in conjunction with the screw-threadable adjustment member 25 to meter precise amounts of fuel which controls the idling rate of the carburetor 10. The screw-threadable adjustment member has a conical forward end 26 which engages the peripheral seat 30 defining an annular flow passage when the adjustment member is displaced from the seat.

Located adjacent to the rotary valve 50 is the secondary restrictor 31. The secondary restrictor functions in conjunction with the rotary valve. As FIG. 9 clearly illustrates, the rotary valve is mounted in fluid-flow relation between conduit 23 and the secondary restrictor. As should be evident from a study of FIG. 9, the rotary valve is mounted, and is adjustable to impede fluid-flow from the secondary restrictor to the conduit 23. The secondary restrictor is connected in fluid-flow relation with the conduit 23 by fuel passage 53. As clearly illustrated in FIG. 9, the movement of the actuating shaft 51 causes the rotary valve 50 to be placed in an appropriate attitude which either impedes or permits the flow of fuel through the secondary restrictor to the conduit 23.

The rotary valve linkage is generally indicated by the numeral 54. The rotary valve linkage consists of a first, second and third element, denominated numerically 55, 60 and 61, respectively. As best illustrated by reference to FIG. 9, the first element 55 has a first end 62 and an opposite second end 63. Located adjacent to the first end is an orifice 64 which is adapted to receive the actuating shaft 51 of the rotary valve 50. The actuating shaft is inserted through the orifice and the first element is securely affixed to the actuating shaft by conventional fastening means.

Located adjacent to the second end 63 of the first element 55 is a first peg 65. The peg is adapted to receive and hold for pivotal motion the first end 70 of the second element 60. It should be obvious that the first end is provided with a suitable orifice, which is not shown, which permits the peg to be inserted therethrough. Likewise, the second end 71 of the second element is provided with a similar orifice which permits the second peg 73 to be inserted therethrough to permit a similar pivotal motion.

The first end 74 of the third element 61 is provided with an orifice 75, which is of a diameter substantially equal to the diameter of the first end of the venturi axle 43 which extends therethrough the wall of the carburetor reservoir 11. The first end of the venturi axle extends therethrough the orifice 75 and the first end of the third element is firmly affixed thereto by conventional fastening means.

In operation, it should be evident that as the venturi axle 40 and the corresponding first end of the venturi axle 43 rotate, the third element 61 is caused to rotate, which in turn causes the motion of the second element 60 and the first element 55. The rotation of the venturi axle causes movement of the third element in a clockwise fashion, and the first element, in a counterclockwise fashion. Motion of the venturi axle, therefore, causes the actuating shaft 51 to rotate about its longitudinal axis which permits the rotary valve 50 to be moved to an advantageous attitude whereby the rotary valve is no longer in impeding fluid-flow relation therebetween the secondary restrictor 31 and the conduit 23. It should be evident, that the secondary restrictor, working in combination with the rotary valve, constitutes a secondary system for flow metering for full throttle operation of the engine.

OPERATION

The operation of the described first and second embodiments of the subject invention is believed to be readily apparent and is briefly summarized at this point. For the sake of clarity, what follows is a description of the operation of the first embodiment of the subject invention. The operation of the second embodiment of the subject invention will be indicated clearly in the paragraphs which follow.

A fuel control system for a carburetor is shown in FIG. 8 with supporting surfaces removed for illustrative convenience. Depicted therein is a primary restrictor 22, said restrictor connecting a carburetor reservoir 11 and the carburetor nozzle bar 12 in fluid-flow relation. The primary adjustable jet 24 has a screw-threadable adjustment member 25 that controls the amount of fuel that is provided from the primary adjustable jet to the carburetor nozzle bar. A secondary restrictor 31 is attached in fluid-flow relation to the nozzle bar by a fuel passage 35. Mounted in impeding fluid-flow relation to this fuel passage is a spring-loaded plunger 33. This spring-loaded plunger is held in impeding fluid-flow relation to the fuel passage 35 by a metering cam 32 which is mounted in impeding relation axially of the plunger to prevent extension thereof. The metering cam 32 is attached to the first end of the venturi axle 40. As the pivotally positionable venturi plates 13 move away from the nozzle bar 12, in response to air rushing into the throat of the carburetor 15, a venturi axle 40 rotates to cause the metering cam that is attached thereto to move in like fashion. The spring-loaded plunger 33, which is urged upwardly against the surface of the metering cam by the action of the plunger spring 45, rises. A decreased diameter section of the plunger 34 is then exposed to the fuel passage 35 which leads from the secondary restrictor to the conduit 23 that connects the primary restrictor in fluid-flow relation to the nozzle bar. This decreased diameter section allows fuel to pass through the opening in the secondary restrictor to the fuel passage 35 and into the conduit connecting the primary restrictor and the nozzle bar. Likewise, as the force of air entering the throat of the carburetor decreases, the spring 44 causes the linkage mechanism 41 to move the pivotally positionable venturi plates back to a position in the throat of the carburetor wherein the carburetor plates substantially occlude the opening in the throat of the carburetor. The motion of the plates back to this occluded position causes the cam attached to the first end of the venturi plate axle to rotate in like fashion forcing the spring-loaded plunger, which is urged upwardly against its surface, downwardly, such that the decreased diameter section of the plunger is moved away from the fuel passage 35. The plunger moved into this position thus impedes the flow of fuel coming from the secondary restrictor to the conduit connecting the primary restrictor with the nozzle bar. It has been found that the amount of fuel passing through the primary adjustable jet 24 and the primary restrictor 22 is somewhat dependent upon the amount of pressure reduction incurred in the throat of the carburetor, the cross-sectional area of the primary restrictor, and the cross-sectional area of the primary adjustable jet. As noted earlier, the primary and secondary restrictors are removable and replaceable, thus allowing the carburetor to be modified to operate at different performance levels. In the first and second operational embodiment, the primary and secondary restrictor are screw-threadably adapted to engage the carburetor housing 14 in the reservoir 11 of the carburetor.

As the engine performs at speeds varying from an idle through part-throttle operation, fuel enters in through the primary restrictors 22 and the primary adjustable jets 24 into conduit 23 and thence into the nozzle bar 12. In the preferred embodiment, the primary restrictor is connected in parallel fluid-flow relation to the primary adjustable jet between the source of fuel and the nozzle bar. Upon entering the nozzle bar 12, the fuel exits through a plenary number of laterally disposed orifices 21 disposed therebetween a plenary number of ribs 42 on the nozzle bar. At these engine speeds, the spring 44 connected to the linkage device of the pivotally positionable venturi plates 41 retains the pivotally positionable venturi plates 13 adjacent to the nozzle bar 12, thus substantially occluding the throat of the carburetor. As engine speed increases however, air rushes in the throat of the carburetor causing the pivotally positionable venturi plates to move substantially automatically equally and oppositely some distance away from the nozzle bar 12. As the force of the air causes these pivotally positionable venturi plates to move away from the nozzle bar, the axle 40 is caused to rotate in like fashion. A metering cam 32 is attached to the first end 43 and moves in corresponding fashion with the movement of the first end 43. As the metering cam 32 moves, the spring-loaded plunger 33, which is mounted in impeded fluid-flow relation to the fuel passage 35, connecting the secondary restrictor 31 to the conduit that joins the primary restrictor 22 with the nozzle valve, is permitted to rise, thus exposing a decreased diameter section 34. This decreased diameter portion allows fuel to pass from the secondary restrictor through the fuel passage 35 and thence into the conduit connecting the primary restrictor with the nozzle bar. This fuel passing from the secondary restrictor augments the fuel being provided from the primary restrictor and the primary adjustable jet. This invention thus meters the fuel that is required for the engine to operate in a wide-throttle position.

As the engine speed decreases, the spring 44, causes the pivotally positionable venturi plates, which have been moved away from the nozzle bar 12 by the force of air entering the throat 15 of the carburetor, to move back into a position whereby the pivotally positionable venturi plates substantially occlude the throat of the carburetor. As the pivotally positionable venturi plates move back to position, the cam 32 which is mounted in impeding relation axially of the spring-loaded plunger 33, moves the plunger downwardly, thus impeding fuel flowing in through the secondary restrictor and into the fuel passage 35. In this configuration, the metering of fuel that is required for wide-throttle operation is effectively implemented.

A fuel control system for a carburetor is shown in FIG. 9 with the supporting surfaces removed for illustrative convenience. Depicted therein is the second embodiment of the subject invention which has common elements which have heretofore been described. For the sake of brevity therefore, the elements which are common to the first and second embodiments will not be discussed in significant detail. However, the interaction of the common elements, as they may effect an element which is peculiar to the second embodiment of the subject invention, will be discussed in thorough detail.

As illustrated in FIG. 9, a rotary valve 50 is provided which is mounted in impeding, fluid-flow relation to the fuel provided from the secondary restrictor 31. As discussed earlier, the secondary restrictor is attached in fluid-flow relation to the nozzle bar 12 by a fuel passage 53. The rotary valve is actuated by a rotary valve linkage 54 which is deployed in an appropriate attitude, whereby the actuation of the rotary valve substantially corresponds with the movement of the variable venturi plates 13 disposed in the throat 15 of the carburetor. It should be evident by a study of FIG. 9 that the rotary valve is attached to the first end of the venturi axle 43 by the rotary valve linkage 54. As the pivotally positionable venturi plates move away from the nozzle bar 12, in response to air rushing in the throat of the carburetor 15, the venturi axle 40 rotates to cause the rotary valve linkage to move in like fashion. The movement of the rotary valve linkage, causes the actuating shaft 51 to rotate in a counterclockwise fashion. The movement of this actuating shaft causes the rotary valve to be placed in an appropriate attitude whereby it no longer impedes the fuel flowing therethrough the secondary restrictor.

Movement of the actuating shaft 51 to an appropriate attitude permits the fuel to pass through the opening in the secondary restrictor to the fuel passage 53 and into the conduit 23 connecting the primary restrictor 22 and the nozzle bar 12. As the force of air entering the throat 15 of the carburetor decreases, the spring 44 causes the linkage mechanism 41 to move the pivotally positionable venturi plates 13 back to a position in the throat of the carburetor wherein the venturi plates substantially occlude the opening of the throat of the carburetor. The motion of the venturi plates back to this occluded position causes the rotary valve linkage 54 attached to the first end of the venturi axle 43 to move the actuating shaft 51 in a clockwise direction such that the rotary valve is placed in an attitude which impedes the flow of fuel from the secondary restrictor 31 to the conduit 23.

As described in the operation of the first operational embodiment, the amount of fuel passing through the primary adjustable jet 24 and the primary restrictor 22 is somewhat dependent upon the amount of pressure reduction incurred in the throat 15 of the carburetor, the cross-sectional area of the primary restrictor, and the cross-sectional area of the primary adjustable jet 24. In like fashion, the primary and secondary restrictors are removable and replaceable, thus permitting the carburetor to be modified to operate at different performance levels. In all other aspects, the operation of the second embodiment of the present invention functions in a manner identical to that of the first embodiment. It should be apparent that this configuration permits the metering of fuel that is required for wide-throttle operation.

Additional advantages and modifications will readily occur to those skilled in the art. The invention in its broader aspects is therefore not limited to the specific details and representative apparatus and the illustrative examples shown and described. Accordingly, departures may be made from the details without departing from the spirit or scope of this disclosed general inventive concept.

Having described our invention, what we claim as new and desire to secure by Letters Patent is:

1. A fuel control system for a carburetor having a housing defining a throat through which air and fuel are drawn, said carburetor having pivotally positionable venturi plates disposed in the throat of the carburetor; and a reservoir; nozzle bar; and fuel supply connected in fluid-flow relation, said fuel control system comprising: a primary restrictor, said restrictor defining a passage therethrough of predetermined cross-sectional area, said restrictor leading to a conduit connecting the reservoir, primary restrictor and nozzle bar in fluid-flow relation; a primary adjustable jet having a screw-threadable adjustment member that controls the amount of fuel that is provided from said adjustable jet to the carburetor nozzle bar, said adjustment member having a conical forward end which engages a peripheral seat defining an annular flow passage when the adjustment member is displaced from the seat; a secondary restrictor connected in fluid-flow relation between the reservoir and the nozzle bar, said secondary restrictor having a spring-loaded plunger mounted in impeding fluid-flow relation to the fuel provided from the secondary restrictor to the nozzle bar; and a metering cam mounted in impeding relation axially of the plunger to prevent the extension thereof, said metering cam movement corresponding with the movement of the variable venturi plates disposed in the throat of the carburetor.

2. A fuel control system for a carburetor having a housing defining a throat through which air and fuel are drawn, said carburetor having pivotally positionable venturi plates disposed in the throat of the carburetor; and a reservoir; nozzle bar; and fuel supply connected in fluid-flow relation, said fuel control system comprising:

a primary restrictor, said restrictor defining a passage therethrough of predetermined cross-sectional area, said restrictor leading to a conduit connecting the reservoir, primary restrictor and nozzle bar in fluid-flow relation;

a primary adjustable jet having a screw-threadable adjustment member that controls the amount of fuel that is provided from said adjustable jet to the carburetor nozzle bar, said adjustment member having a conical forward end which engages a peripheral seat defining an annular flow passage when the adjustment member is displaced from the seat;

a secondary restrictor connected in fluid-flow relation between the reservoir and the nozzle bar, said secondary restrictor having a rotary valve mounted in impeding fluid-flow relation to the fuel provided from the secondary restrictor; and a rotary valve linkage for actuating the rotary valve, said rotary valve linkage deployed to actuate the rotary valve to correspond with the movement of the pivotally positionable venturi plates disposed in the throat of the carburetor.

* * * * *